US010272312B2

(12) United States Patent
Burdette

(10) Patent No.: US 10,272,312 B2
(45) Date of Patent: Apr. 30, 2019

(54) VOLLEYBALL TRAINING APPARATUS

(71) Applicant: Texas Investment Recovery, LLC, Grand Prairie, TX (US)

(72) Inventor: Andrew Burdette, Solana Beach, CA (US)

( * ) Notice: Subject to any disclaimer, the term of this patent is extended or adjusted under 35 U.S.C. 154(b) by 0 days.

(21) Appl. No.: 15/676,723

(22) Filed: Aug. 14, 2017

(65) Prior Publication Data

US 2018/0050251 A1 Feb. 22, 2018

Related U.S. Application Data

(60) Provisional application No. 62/375,876, filed on Aug. 16, 2016.

(51) Int. Cl.
*A63B 69/00* (2006.01)
*A63B 63/08* (2006.01)
(Continued)

(52) U.S. Cl.
CPC ..... *A63B 69/0095* (2013.01); *A63B 63/08* (2013.01); *A63B 2071/025* (2013.01);
(Continued)

(58) Field of Classification Search
USPC ..... 473/173, 195, 196, 422, 459, 462, 473, 473/474, 479–486
See application file for complete search history.

(56) References Cited

U.S. PATENT DOCUMENTS 4,092,023 A * 5/1978 Hazen ..... A63B 63/00 273/369
4,208,050 A * 6/1980 Perrine ..... A63B 5/16 473/447
(Continued)

FOREIGN PATENT DOCUMENTS

JP 3139357 * 2/2008
JP 3139357 U 2/2008

OTHER PUBLICATIONS

Target Challenger by Tandem Sport, Louisville, KY, Product Description, http://tandemsport.com/store/products/Target_Challenger_.html, available before Aug. 16, 2016, 5 pp.
(Continued)

*Primary Examiner* — Nini F Legesse
(74) *Attorney, Agent, or Firm* — Richard D. Clarke

(57) ABSTRACT

A sport training apparatus can have a stand with a base and a post attached to the base. A target member can be removably and pivotally coupled to a bearing assembly at a proximal end of the post, so that the angular orientation of the target member relative to the post is selectively adjustable. The target member can optionally include a hoop with a circular opening sized to receive a ball therethrough. The target member can optionally include an arc with a semicircular opening configured to receive a ball therethrough. The target member can optionally include a plurality of elongate flaps, the plurality of flaps can indicate a jumping height of a user when struck and rotated by the user hand. The target member can include a plurality of pads can deflect a ball that strikes the one or more pads. A sport training kit can include the stand and multiple target members, such as those described above.

15 Claims, 18 Drawing Sheets

(51) Int. Cl.
*A63B 71/02* (2006.01)
*A63B 71/06* (2006.01)

(52) U.S. Cl.
CPC . *A63B 2071/026* (2013.01); *A63B 2071/0694* (2013.01); *A63B 2209/00* (2013.01); *A63B 2225/09* (2013.01); *A63B 2225/093* (2013.01); *A63B 2243/0095* (2013.01)

(56) References Cited

U.S. PATENT DOCUMENTS 5,485,993 A * 1/1996 Lipsett ..... A63B 69/0071 473/448
5,584,480 A * 12/1996 Grimsrud ..... A63B 71/023 273/396
6,312,349 B1 * 11/2001 Roberts ..... A63B 69/0071 473/422
7,955,222 B1 * 6/2011 Hernandez ..... A63B 5/16 482/14
8,187,125 B2 * 5/2012 Kaufman ..... A63B 69/385 473/459
8,801,548 B2 * 8/2014 Swingle ..... A63B 63/00 473/195
2003/0130074 A1 7/2003 Petroskey
2005/0134001 A1 6/2005 Rowan
2005/0192126 A1 * 9/2005 Remaklus ..... A63B 63/08 473/447
2010/0261559 A1 * 10/2010 Kaufman ..... A63B 69/385 473/459
2013/0040762 A1 * 2/2013 Swingle ..... A63B 63/00 473/422

OTHER PUBLICATIONS

PCT Search Report/Written Opinion dated Nov. 3, 2017 re PCT/US17/46770, Applicant Texas Investment Recovery, LLC, 27 pp.

* cited by examiner

VOLLEYBALL TRAINING APPARATUS

CROSS-REFERENCE TO RELATED APPLICATIONS

Any and all applications for which a foreign or domestic priority claim is identified in the Application Data Sheet as filed with the present application are hereby incorporated by reference under 37 CFR 1.57 and should be considered a part of this specification.

BACKGROUND OF THE INVENTION

Field

The present invention is directed to a sport training apparatus, and more particularly to a multipurpose sport training apparatus for users to practice their skills or use at a gym.

Description of the Related Art

Volleyball is a popular sport. As with any sport, players need to regularly practice to improve their skills. While it is easy to practice skills like setting and passing with multiple individuals, it is difficult to practice volleyball skills on your own.

SUMMARY

There is a need for an apparatus that allows users to practice their volleyball skills, such as setting, passing and hitting, when on their own. Additionally, there is a need for a modular apparatus that allows a user to practice various skills.

In accordance with one aspect, a training apparatus is provided that can have a stand with a base and a post attached to the base. The apparatus can also have a target member can be removably and pivotally coupled to a bearing assembly at a proximal end of the post, so that the angular orientation of the target member relative to the post is selectively adjustable The target member can optionally include a hoop with a circular openings sized to receive a ball therethrough. The target member can optionally include an arc with a semicircular opening configured to receive a ball therethrough. The target member can optionally include a plurality of elongate flaps, the plurality of flaps can indicate a jumping height of a user when struck and rotated by the user hand. The target member can include a plurality of pads can deflect a ball that strikes the one or more pads. A volleyball training kit can include the stand and multiple target members, such as those described above.

In accordance with another aspect, a volleyball training apparatus is provided. The apparatus comprises a base and a support member attached to the base at its distal end and extending generally perpendicular relative to the base. A bearing assembly is coupled to a proximal end of the support member, the bearing assembly having a hub portion angularly adjustable relative to the support member. The apparatus also comprises a target member removably coupleable to the hub portion of the bearing assembly, wherein the angular orientation of the target member relative to the support member is selectively adjustable.

In accordance with another aspect, a volleyball training kit is provided. The kit comprises a support stand comprising a base and a post attached to the base at its distal end and extending generally perpendicular relative to the base. A base assembly is coupled to a proximal end of the post, the bearing assembly having a hub portion angularly adjustable relative to the post. The kit also comprises a plurality of interchangeable target members removably coupleable to the hub portion of the bearing assembly. The target members include one or more hoops having a circular opening configured to receive a ball therethrough, one or more arcs defining a semicircular opening configured to receive a ball therethrough, a plurality of spaced apart and elongate flaps rotatably coupled to a rod of the elongate member, the plurality of flaps configured to indicate a jumping height of a user when struck and rotated relative to the rod, and one or more pads coupled to a cross-bar of the target member, the one or more pads configured to deflect a ball that strikes the one or more pads. The angular orientation of the target member relative to the support member is selectively adjustable.

In accordance with another aspect, a volleyball training apparatus is provided. The apparatus comprises a base and a post attached to the base at its distal end and extending generally perpendicular relative to the base. The apparatus also comprises a bearing assembly coupled to a proximal end of the post, the bearing assembly having a hub portion angularly adjustable relative to the post. The apparatus also comprises a target member removably coupleable to the hub portion of the bearing assembly, the target member having a hoop or arc shape that defines an opening. The angular orientation of the target member relative to the support member is selectively adjustable to change the orientation of the opening.

In accordance with another aspect, a volleyball training apparatus is provided. The apparatus comprises a base and a post attached to the base at its distal end and extending generally perpendicular relative to the base. The apparatus also comprises a bearing assembly coupled to a proximal end of the post, the bearing assembly having a hub portion angularly adjustable relative to the post. The apparatus also comprises a target member removably coupleable to the hub portion of the bearing assembly, the target member comprising a plurality of spaced apart and rotatable elongate flaps. The angular orientation of the target member relative to the support member is selectively adjustable, and wherein rotation of one or more of the plurality of flaps is configured to indicate a jumping height of a user.

In accordance with another aspect, a volleyball training apparatus is provided. The apparatus comprises a base and a post attached to the base at its distal end and extending generally perpendicular relative to the base. The apparatus also comprises a bearing assembly coupled to a proximal end of the post, the bearing assembly having a hub portion angularly adjustable relative to the post. The apparatus also comprises a target member removably coupleable to the hub portion of the bearing assembly, the target member comprising one or more pads oriented generally perpendicular to a cross-bar, the cross-bar oriented generally perpendicular to the post. The angular orientation of the target member relative to the support member is selectively adjustable, and wherein the one or more pads are configured to deflect a ball that strikes the one or more pads.

DETAILED DESCRIPTION

Figure 1:
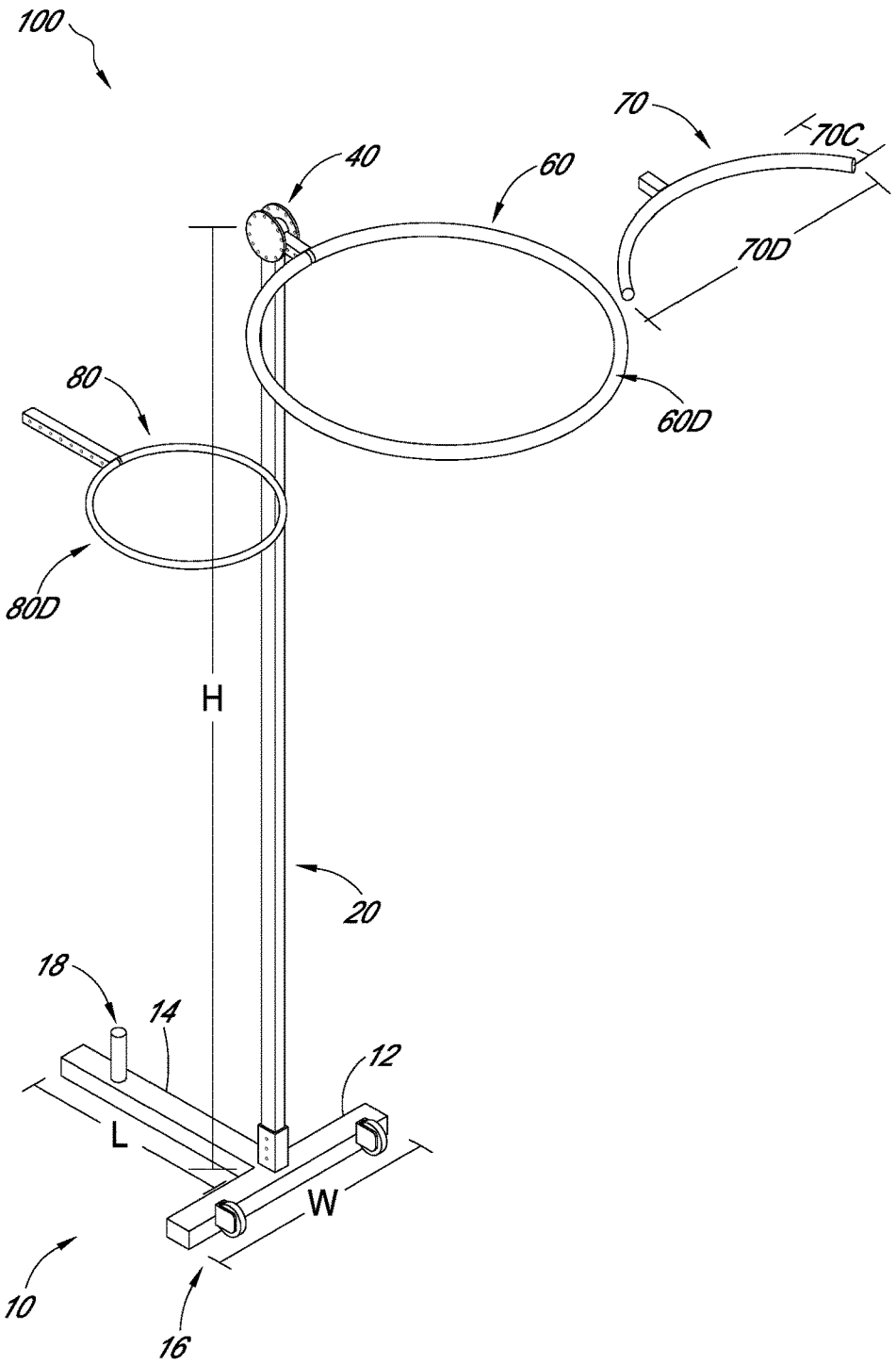
FIG. 1 is a perspective view of one embodiment of a training apparatus.
Figure 2:
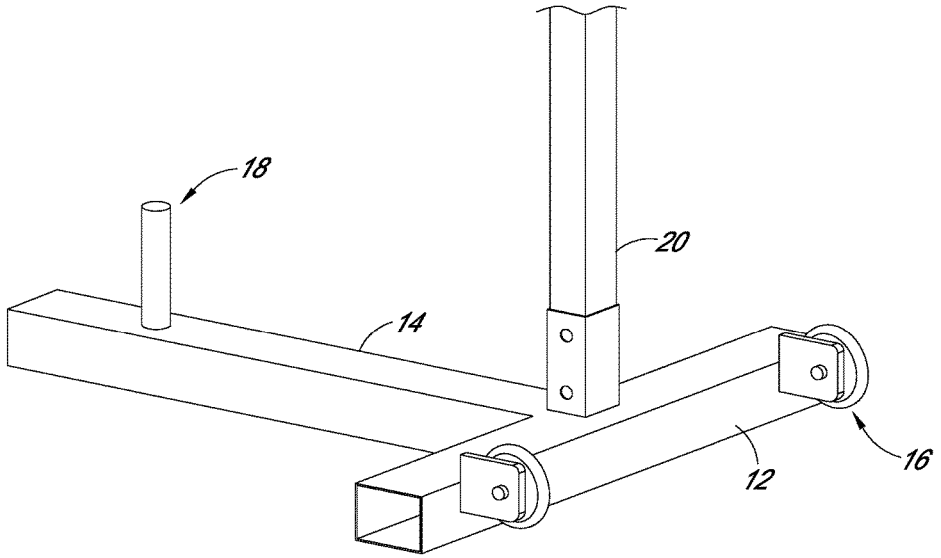
FIG. 2 is a partial view of a base of the training apparatus.

FIGS. 1-13 show a training apparatus or target device 100 (hereinafter "the target device"). The target device 100 can have a base 10, a support member 20 a bearing assembly 40 and a target member 60, 70, 80 that can be removably attached to the bearing assembly 40 as further described below. Advantageously, the target device 100 allows a user to practice their athletic skills (e.g., volleyball skills such as setting, passing, hitting, jumping, etc.), and can be used by the user while on their own (e.g., at a gym, outdoors, etc.). The orientation of the target member 60, 70, 80 can advantageously be adjusted relative to the support member, as further described below, to allow the user to practice different skills (e.g., hitting at an angle, reacting to blocked shots, jumping, etc.). The training apparatus 100 can be used in a variety of sports or exercises, and is not limited to use in a particular sport (e.g., not limited to volleyball). For example, a user can use the training apparatus 100 (e.g., at a gym, outdoors) to test or practice their jumping ability.

The base 10 can have a footprint sufficient in size to provide a stable support for the target device 100. In the illustrated embodiment the base 10 can have a T-shape with a first member 12 and second member 14 generally perpendicular to each other. However, the base 10 can have other suitable shapes. The first member 12 can have two or more wheels 16 attached to it to allow the target device 100 to easily be relocated (e.g., by tilting the target device 100 onto the wheels 16 and rolling the target device 100 to a desired location). The second member 14 can optionally have a pin 18 that extends upwardly. In on embodiment, the pin 18 can help maintain a weight in place when placed onto the second member 14 to act as a counterweight on the target device 100 and help maintain the target device 100 from shifting or moving (e.g., tilting) during use. In one embodiment, such a weight can be a typical gym weight with an opening that receives the pin 18 therethrough. However, other suitable mechanisms for counterweighing the target device 100 can be used.

Figure 6:
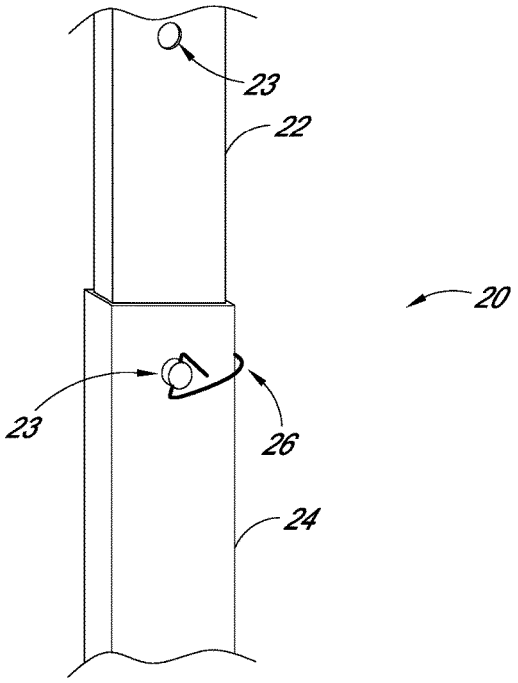
FIG. 6 is a partial view of a vertical support member of the training apparatus.
Figure 7:
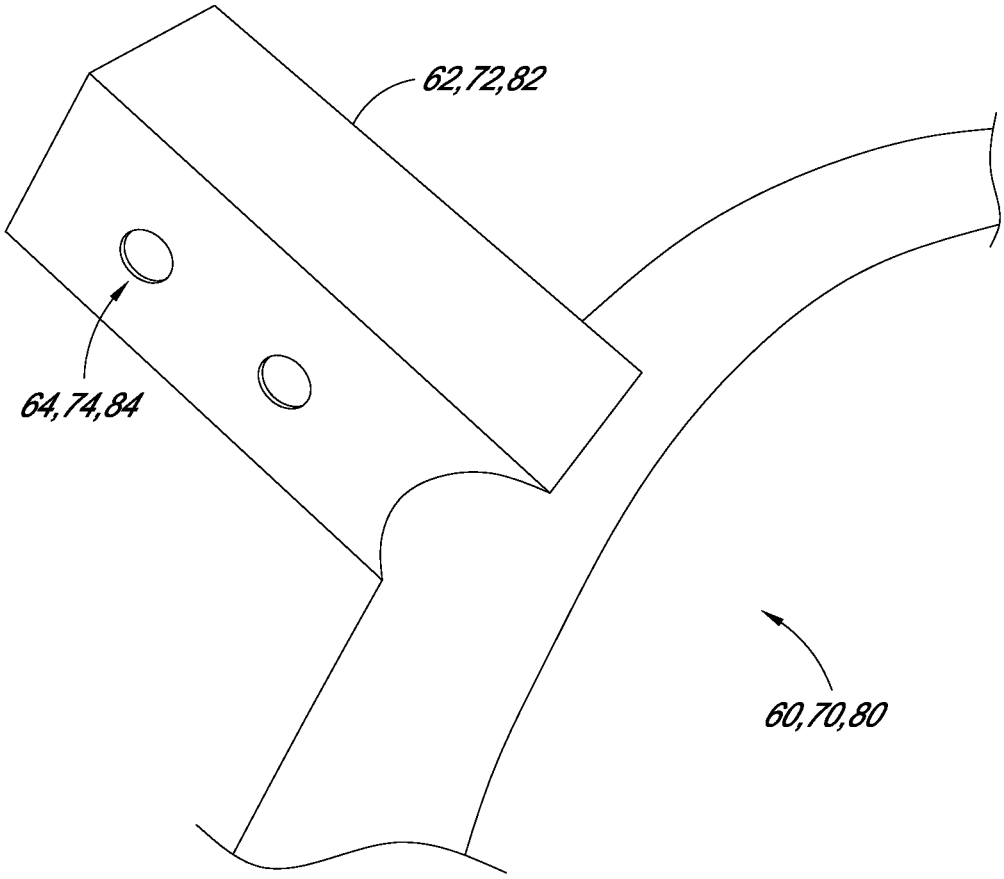
FIG. 7 is a partial view of a target member of the training apparatus.
Figure 8:
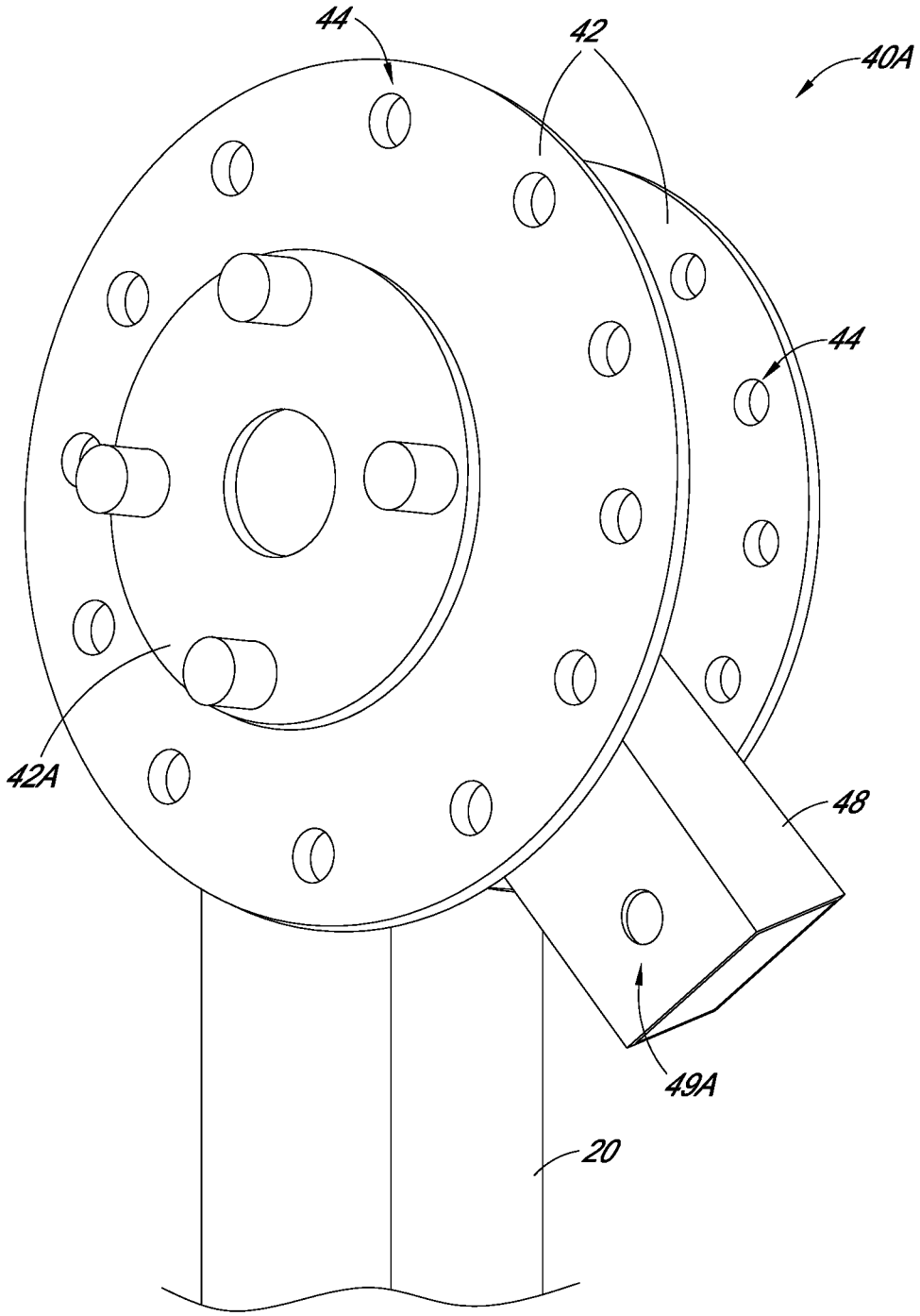
FIG. 8 is a partial assembled view of another embodiment of a bearing assembly attached to the vertical support member of the training apparatus.
Figure 9:
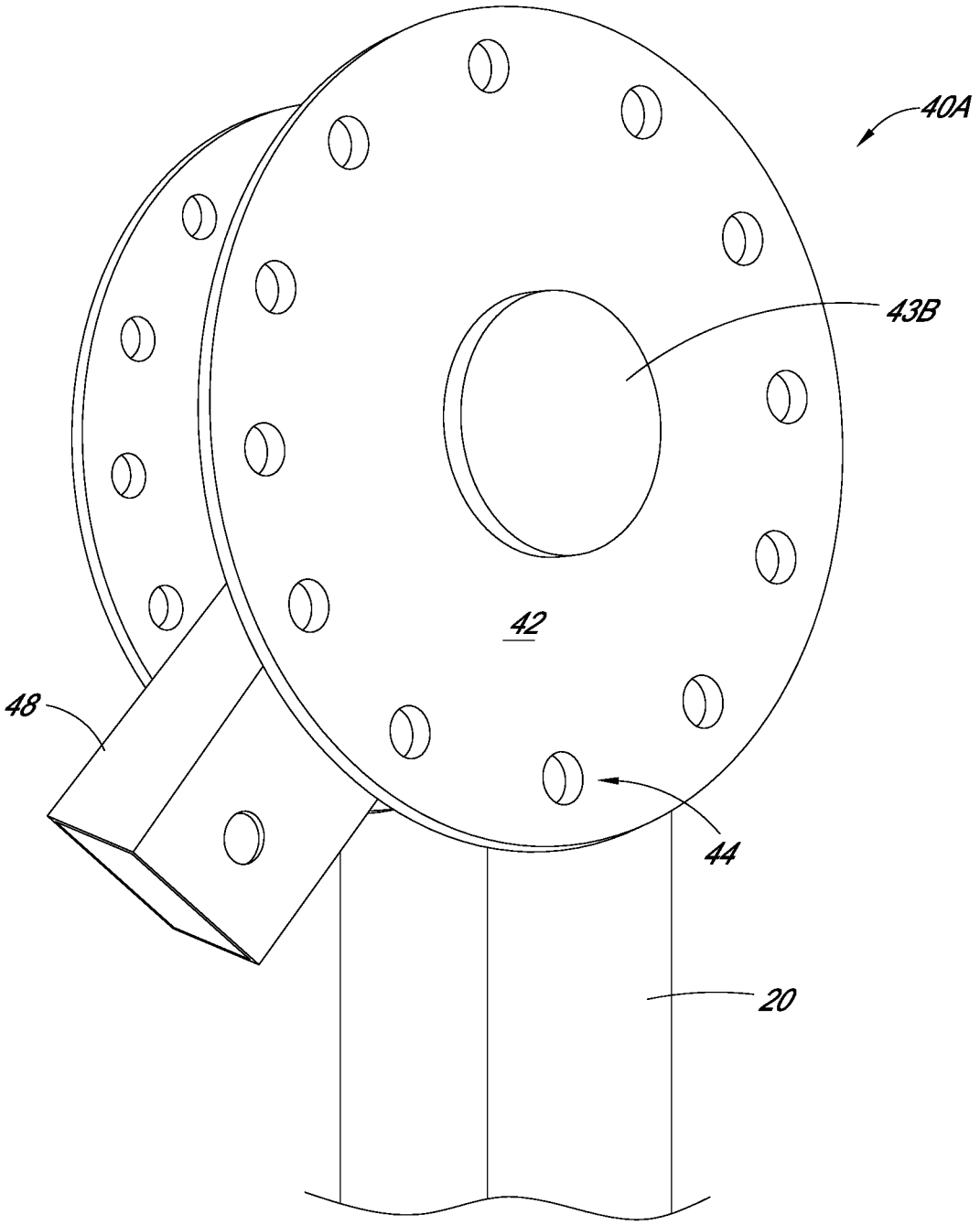
FIG. 9 is an opposite view of the assembled bearing assembly than that shown in FIG. 8.
Figure 10:
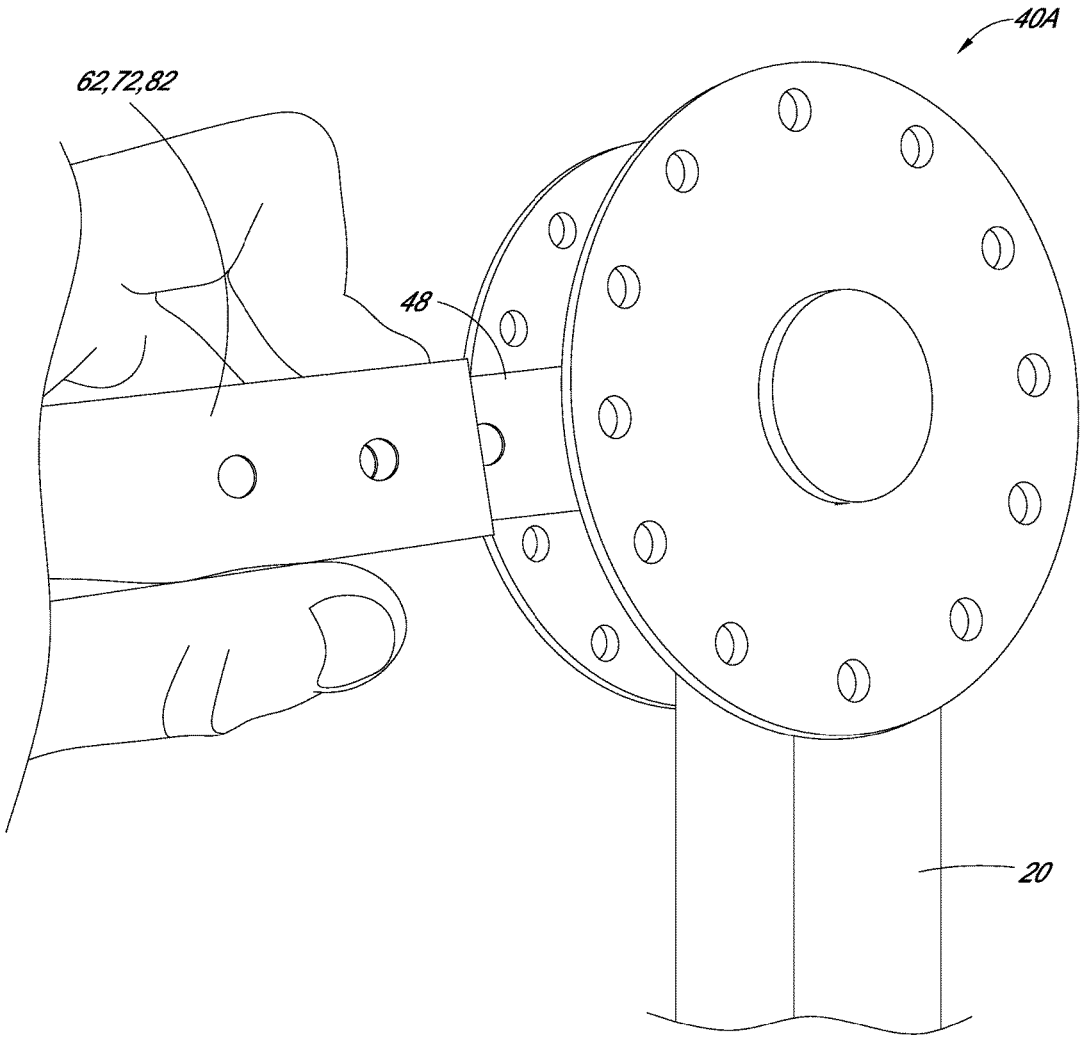
FIG. 10 is a partial view of a connector of a target member being attached to the bearing assembly of FIG. 8 of the training apparatus.
Figure 11:
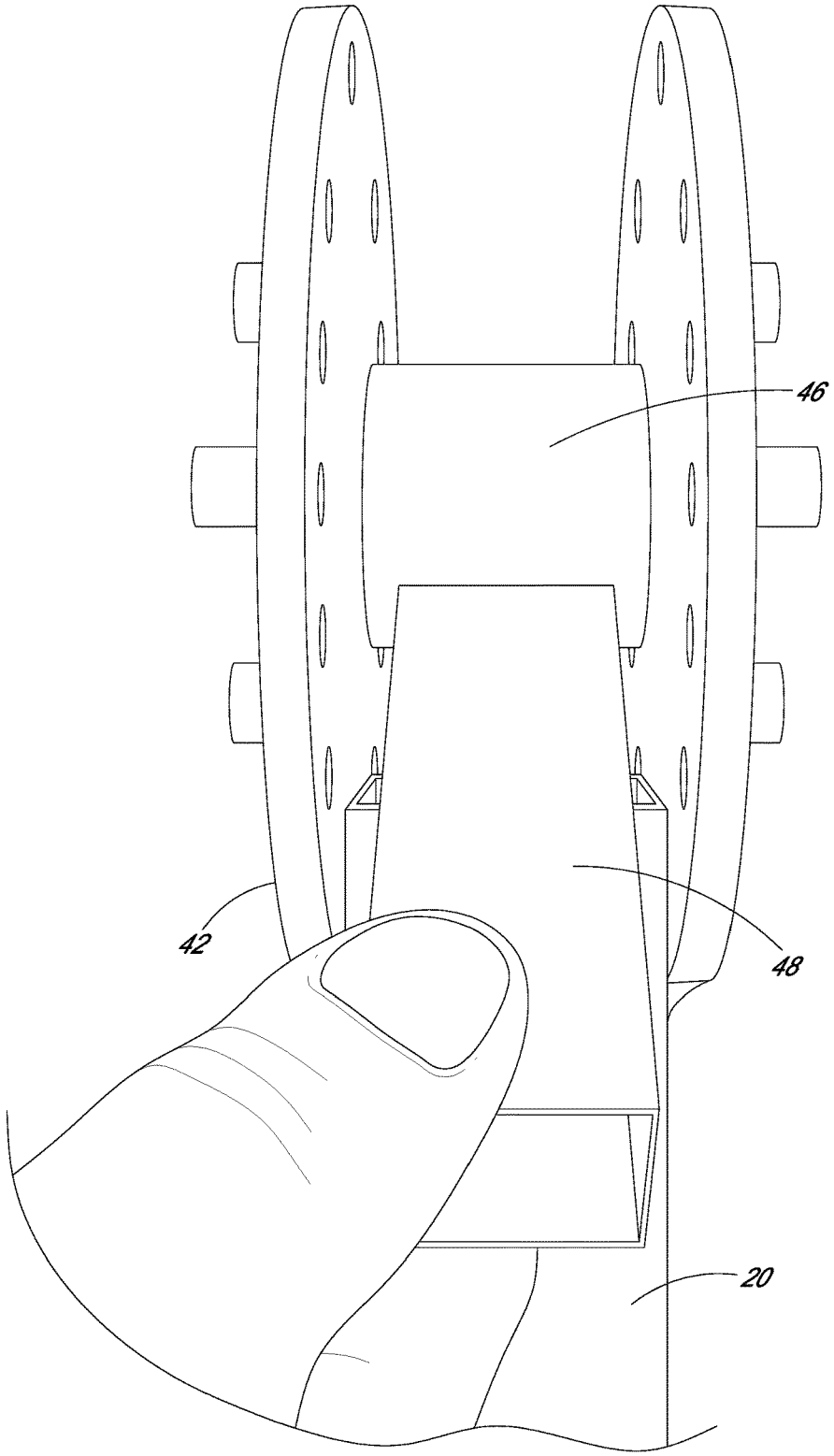
FIG. 11 is a front view of the bearing assembly of the training apparatus of FIG. 8 with the bearing connector in one orientation.
Figure 12:
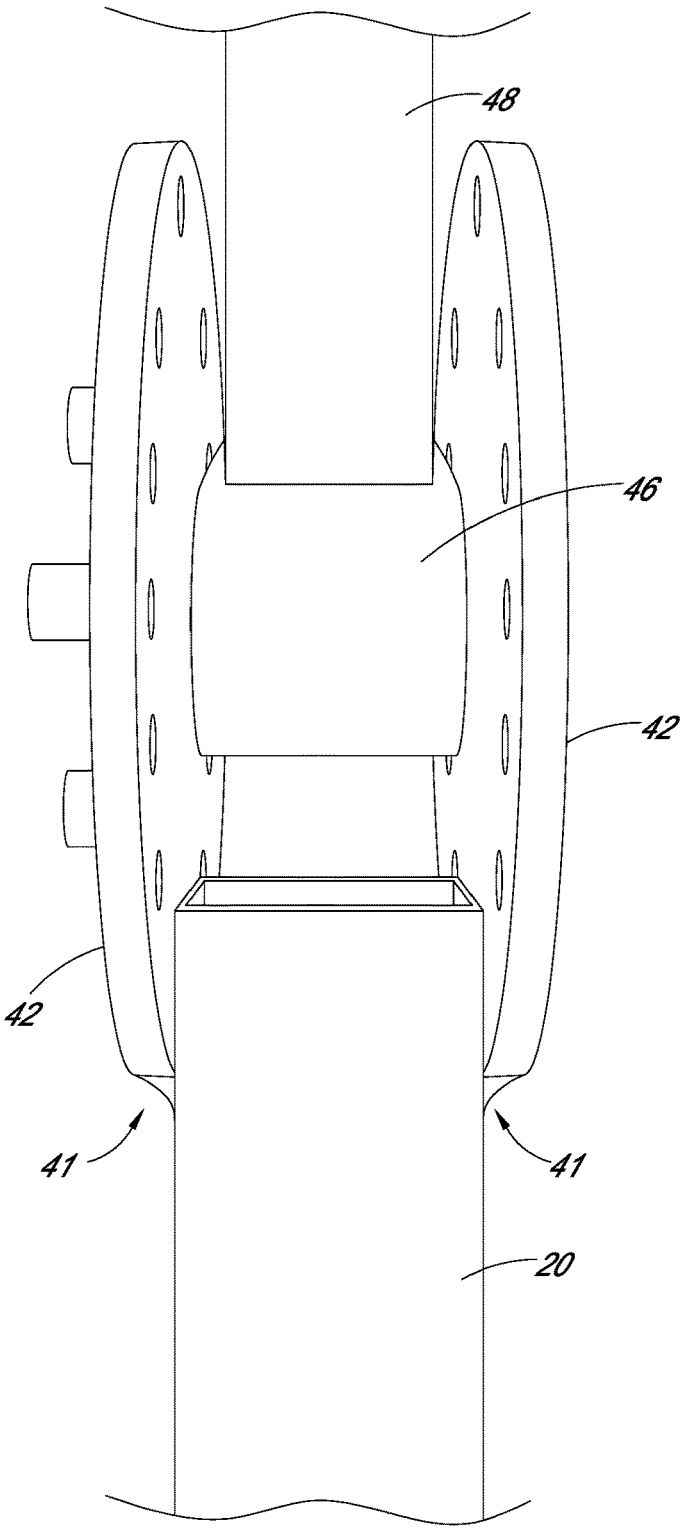
FIG. 12 is a front view of the bearing assembly of the training apparatus of FIG. 8 with the bearing connector in another orientation.
Figure 13:
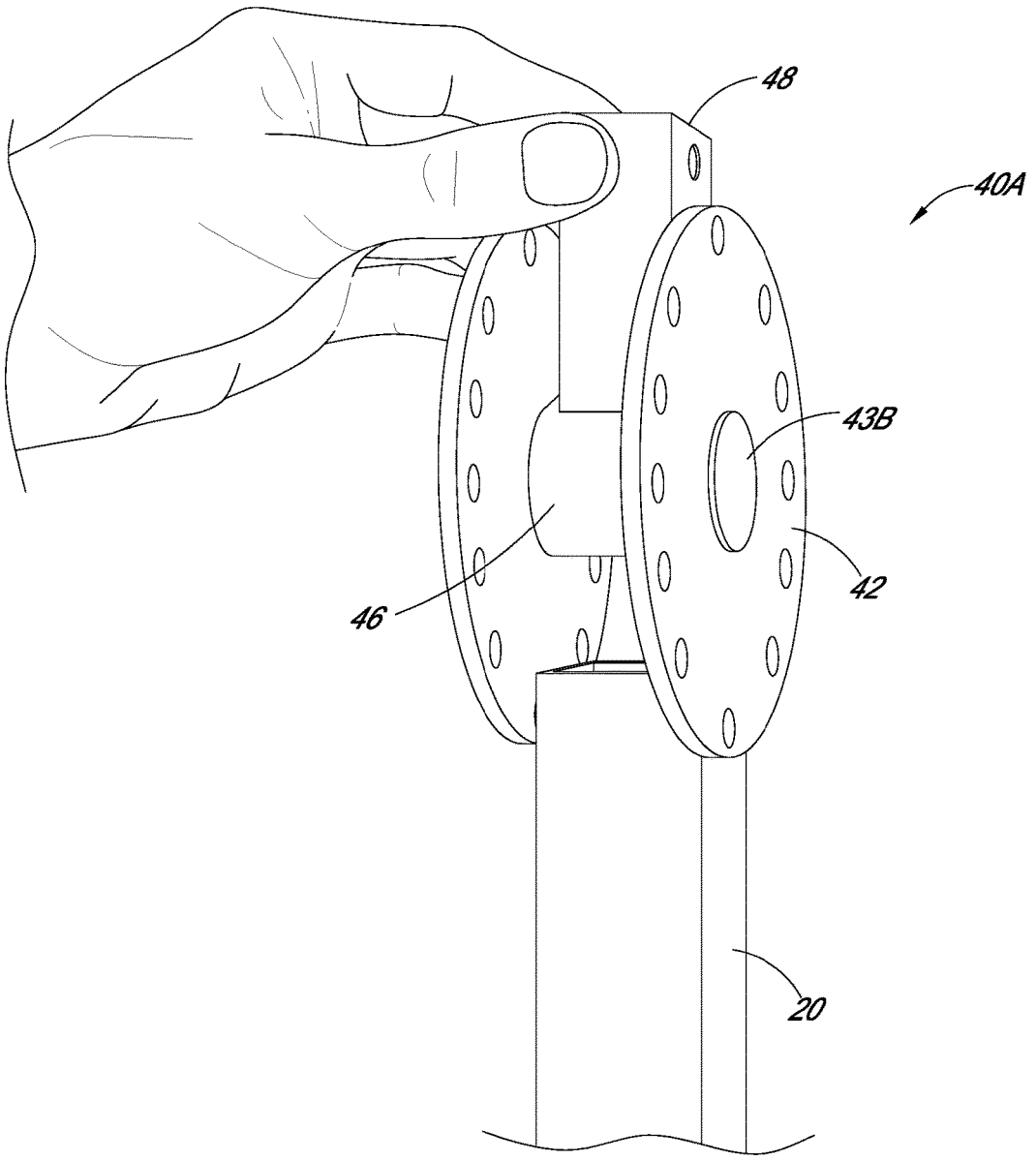
FIG. 13 is a perspective view of the bearing assembly of FIG. 8 attached to the vertical support member, with the bearing connector in another orientation.

With continued reference to FIG. 1, the support member 20 can have a distal end that attaches (e.g., be bolded, welded, etc.) to the base 10 generally at the location where the first and second members 12, 14 join. The support member 20 can extend upright (e.g., generally vertically relative to a ground surface). As best shown in FIG. 6, the support member 20 can optionally have an adjustable height, and include a first support member 22 and a second support member 24 that linearly overlaps with the first support member 22. The first and second support members 20, 22 can each have one or more openings 23 through which a fastener 26 (e.g., pin) can be inserted to fix the position of the first and second members 22, 24 relative to each other.

Figure 3:
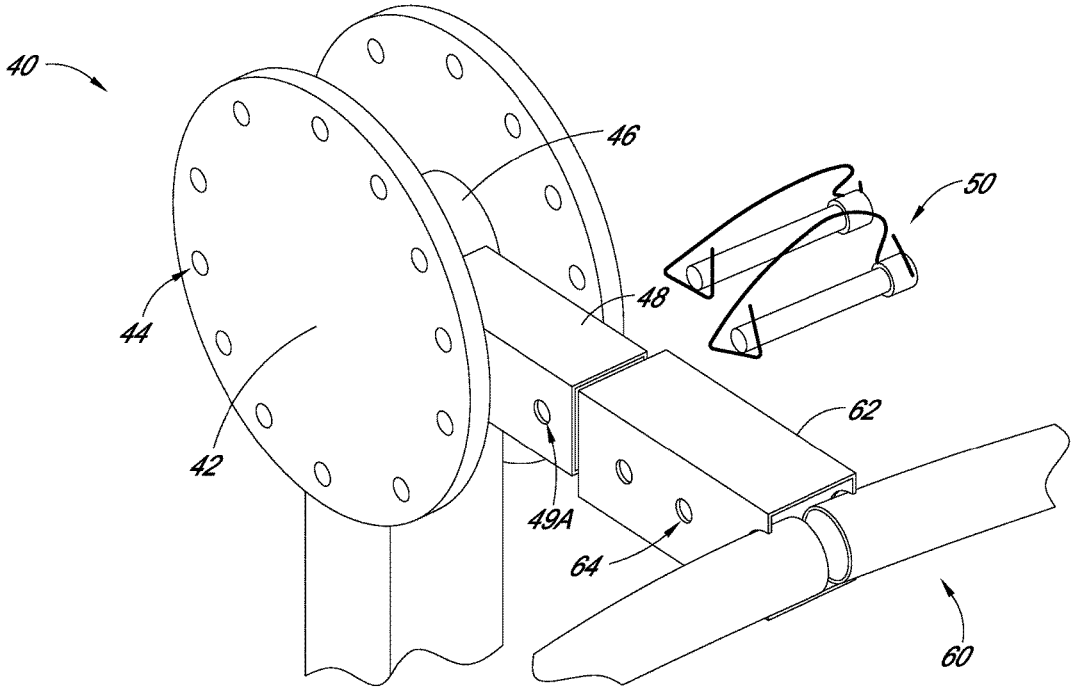
FIG. 3 is a partial exploded view of a bearing assembly of the training apparatus and partial view of a target member attachable to the bearing assembly.
Figure 4:
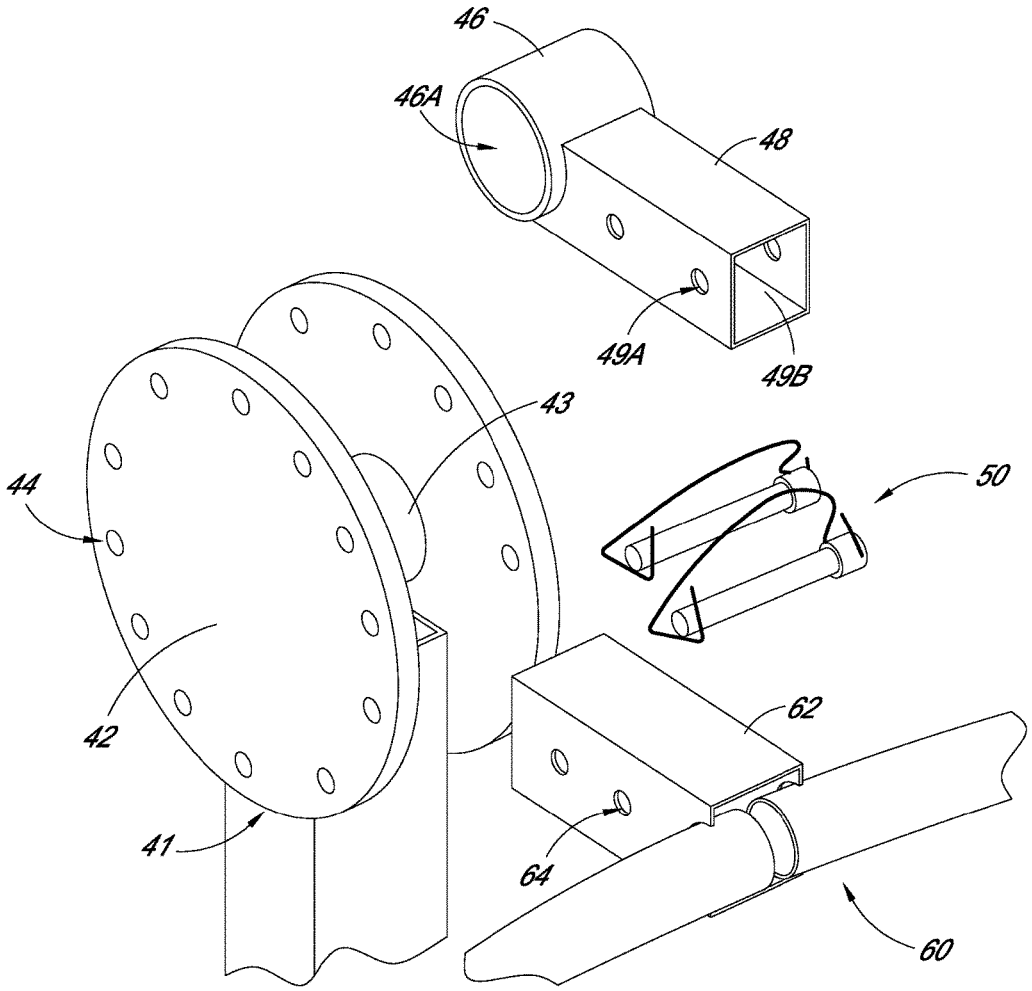
FIG. 4 is a partial exploded view of the bearing assembly of the training apparatus and partial view of a target member attachable to the bearing assembly.
Figure 5:
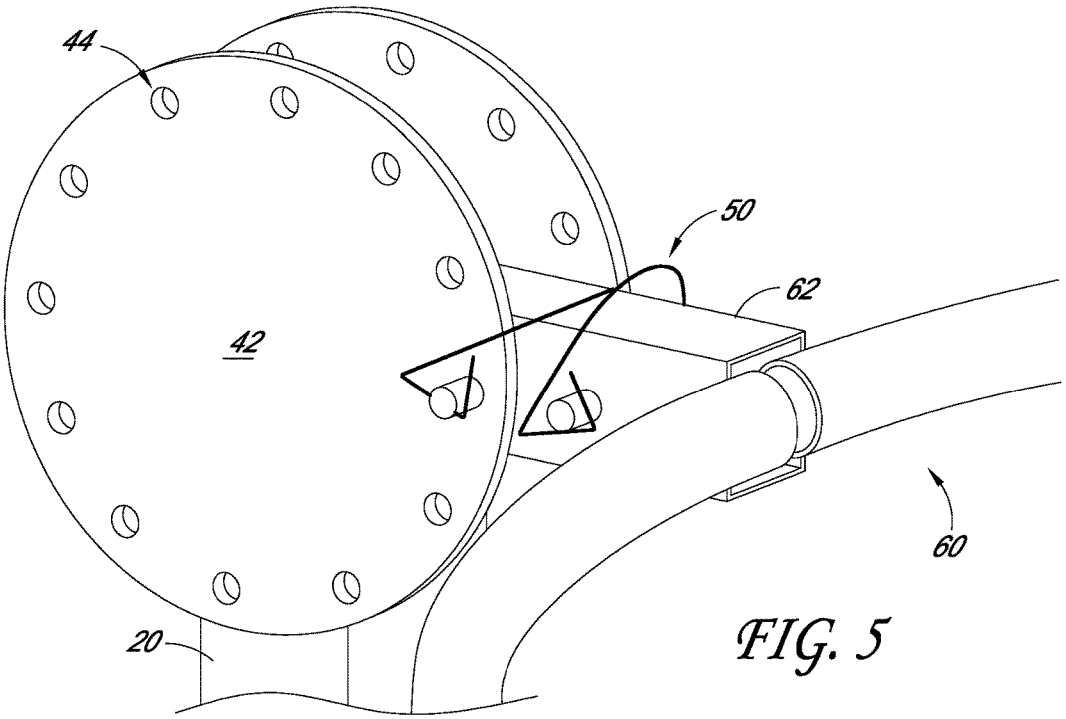
FIG. 5 is a partial assembled view of the bearing assembly of the training apparatus and partial view of a target member attached to the bearing assembly.

With reference to FIGS. 3-5, the bearing assembly 40 can include a pair of plates 42 attached on either side of the proximal end of the support member 20. Optionally, the plates 42 can be welded 41 to the proximal end of the support member 20. The plates 42 can have a plurality of holes or openings 44 along at least a portion of the circumference of the plates 42, where the holes on one of the plates 42 can align with the holes on the other of the plates 42. The bearing assembly 40 can further include a hub 46 with an opening 46A therethrough that is sized to receive an axle or shaft 43 therethrough, where the axle or shaft 43 extends between the plates 42. In one embodiment, the shaft 43 and hub 46 operate as a cylindrical bearing, allowing the hub 46 to pivot relative to the shaft 43. The hub 46 can have a bearing connector 48 attached to it with one or more holes or apertures 49A on its sidewalls, and a central opening 49B along an axis perpendicular to the hub 46.

With reference to FIG. 1, a target member can removably couple to the bearing connector 48 to couple the target member to the bearing assembly 40. Optionally, the target member 60 can have a ring and connector 62. The connector 62 can optionally be welded to the ring of the target member 60. The connector 62 can couple to the bearing connector 48. As best shown in FIGS. 3-4, the connector 62 has openings or holes 64 that can align with the holes 49A in the bearing connector 48. The connector 62 is optionally sized to extend over the bearing connector 48, after which pins 50 can be inserted in aligned holes 49A, 64 of the connectors 48, 62. Alternatively, the bearing connector 48 can instead be sized to extend over the connector 62.

Different types of target members can be attached to the bearing assembly 40 to practice different skills. In addition to the target member 60, a target member 70 that has a semicircular shape can also be provided. Further, a target member 80 can have a smaller diameter ring as compared to the ring of the target member 60, and be used for setting exercises. Each of the target members 60, 70, 80 can advantageously be removably coupled to the bearing assembly 40 via the holes or apertures 64, 74, 84 in their connectors 62, 72, 82 (see FIG. 7) when the user desires to practice a different skill. Accordingly, the target members 60, 70, 80 are advantageously interchangeable. Though the illustrated embodiments disclose three different types of target members (e.g., target members 60, 70, 80), one of skill in the art will recognize that any number of target members can be used, each being interchangeably coupled with the bearing assembly 40, as further discussed below. Optionally, a net can be attached to a bottom side of the ring or semicircular member to direct balls into a basket (not shown) that can be positioned below the target member during use.

FIGS. 8-13 illustrate another embodiment of a bearing assembly 40A, where the hub 46 is provided by a plate 42A that attaches to one of the plates 42 so that the shaft 43B extends through an opening in the other of the plates 42. The bearing assembly 40A operates in a similar manner as the bearing assembly 40 described above.

Figure 14:
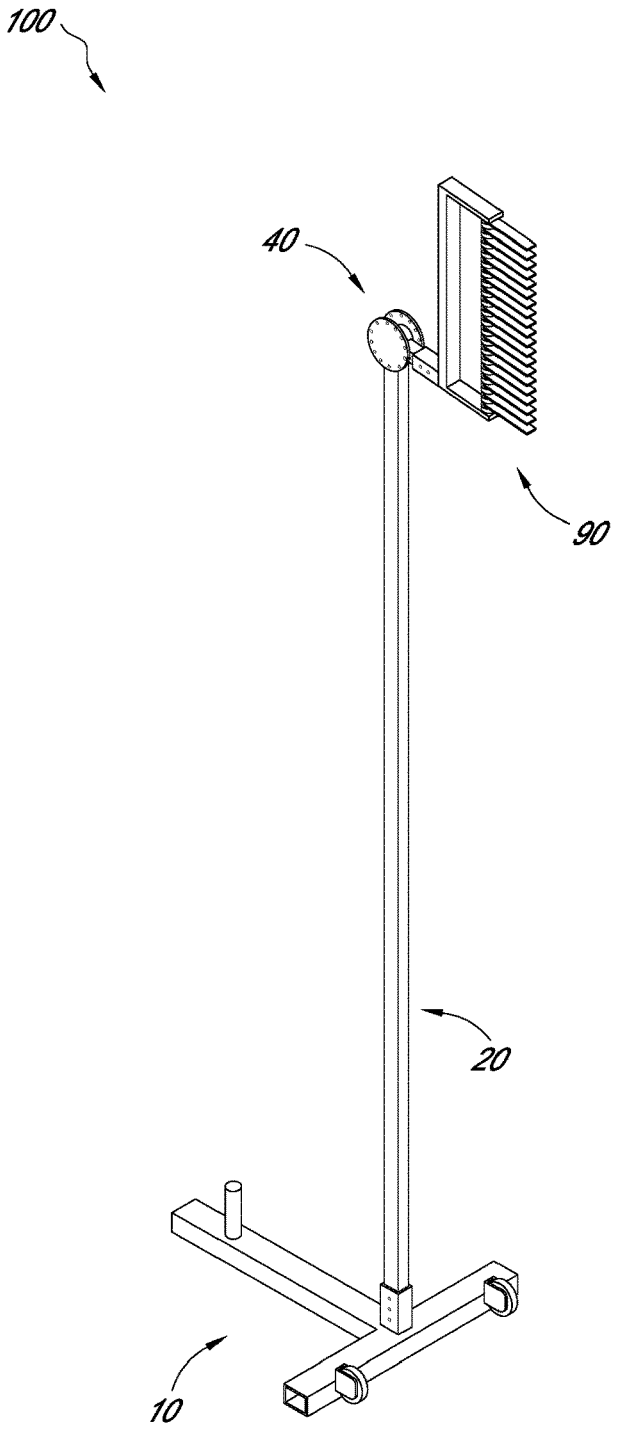
FIGS. 14-14C show a target member for use with the training apparatus.
Figure 14A:
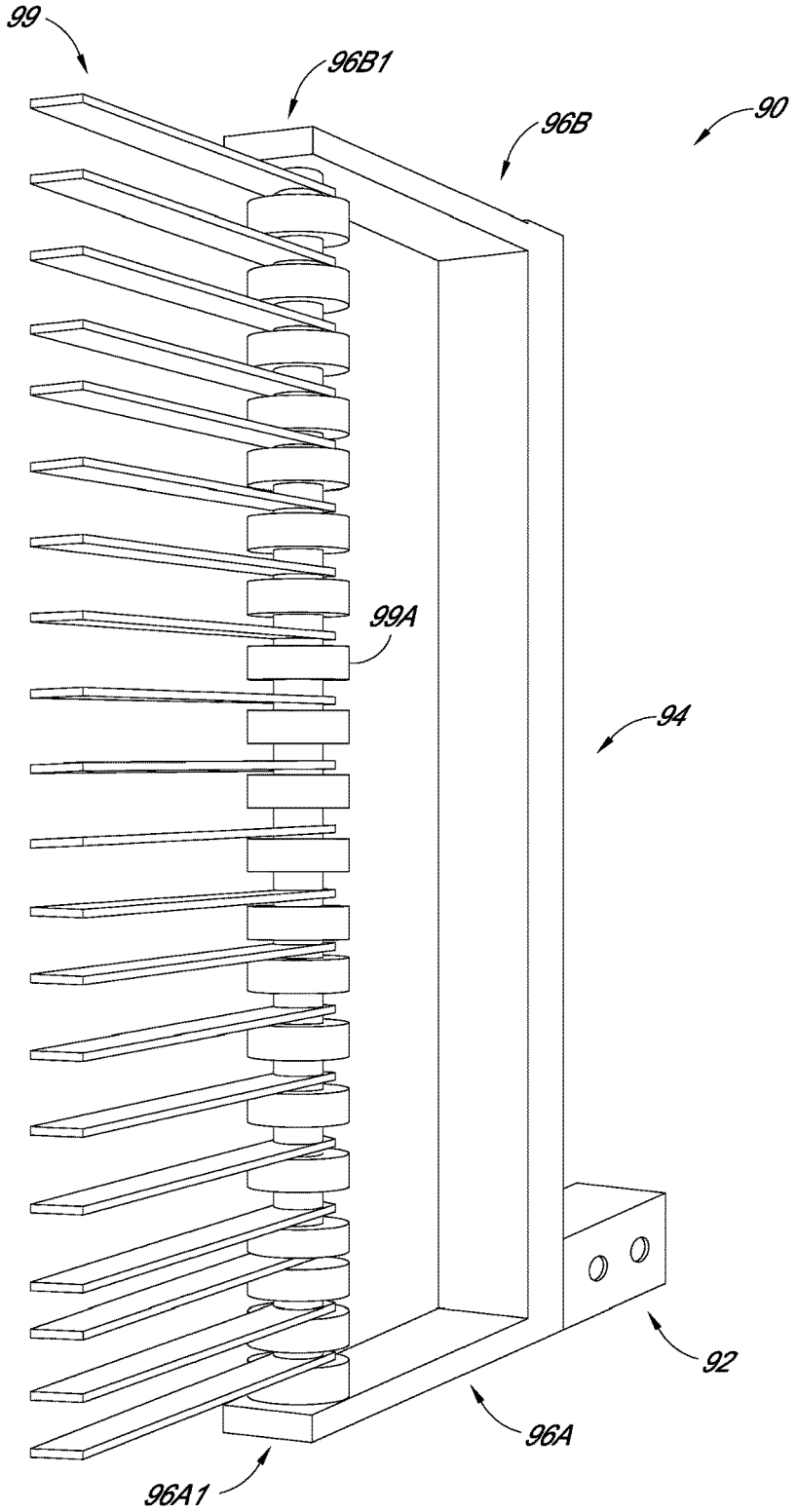
Figure 14B:
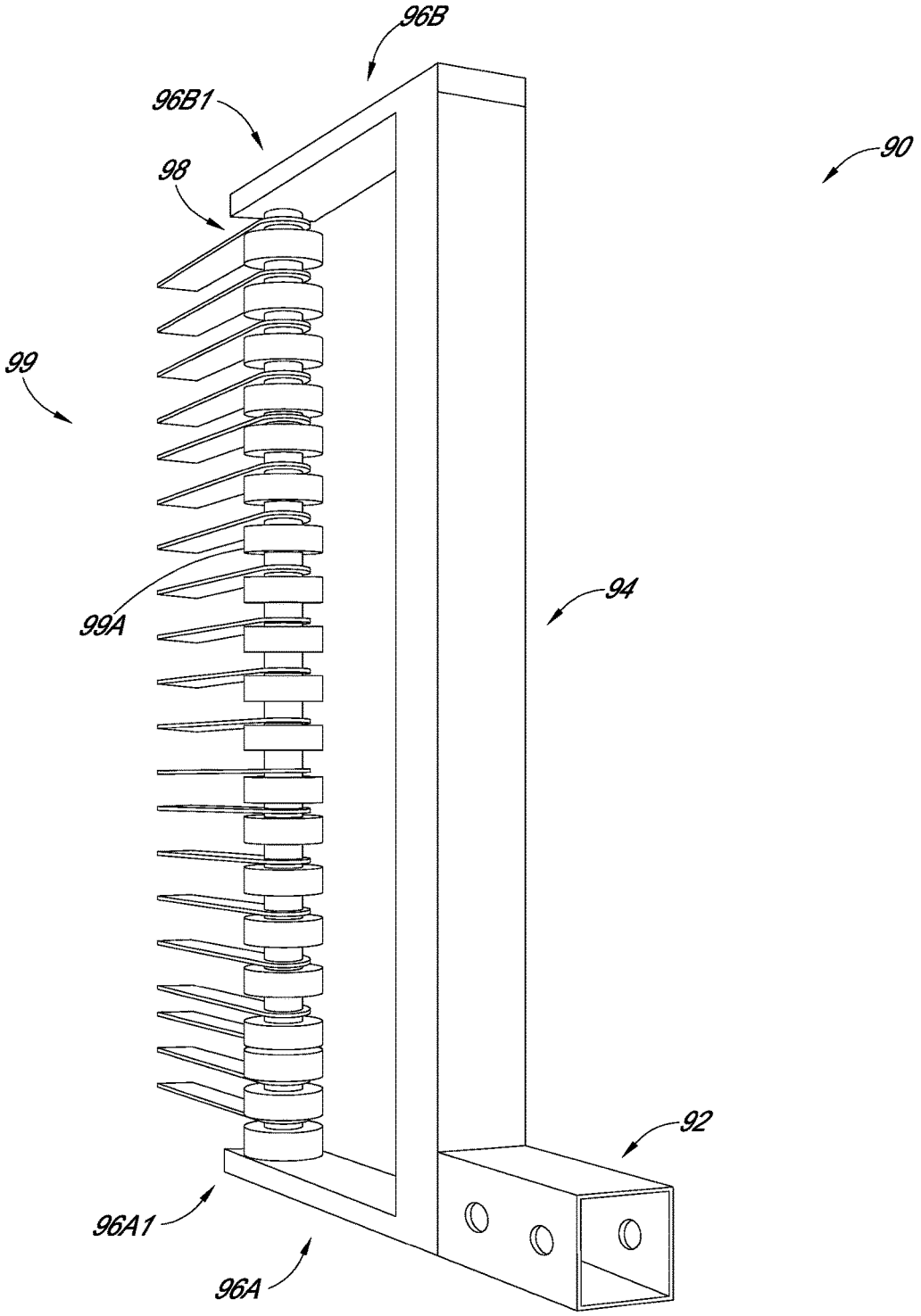
Figure 14C:
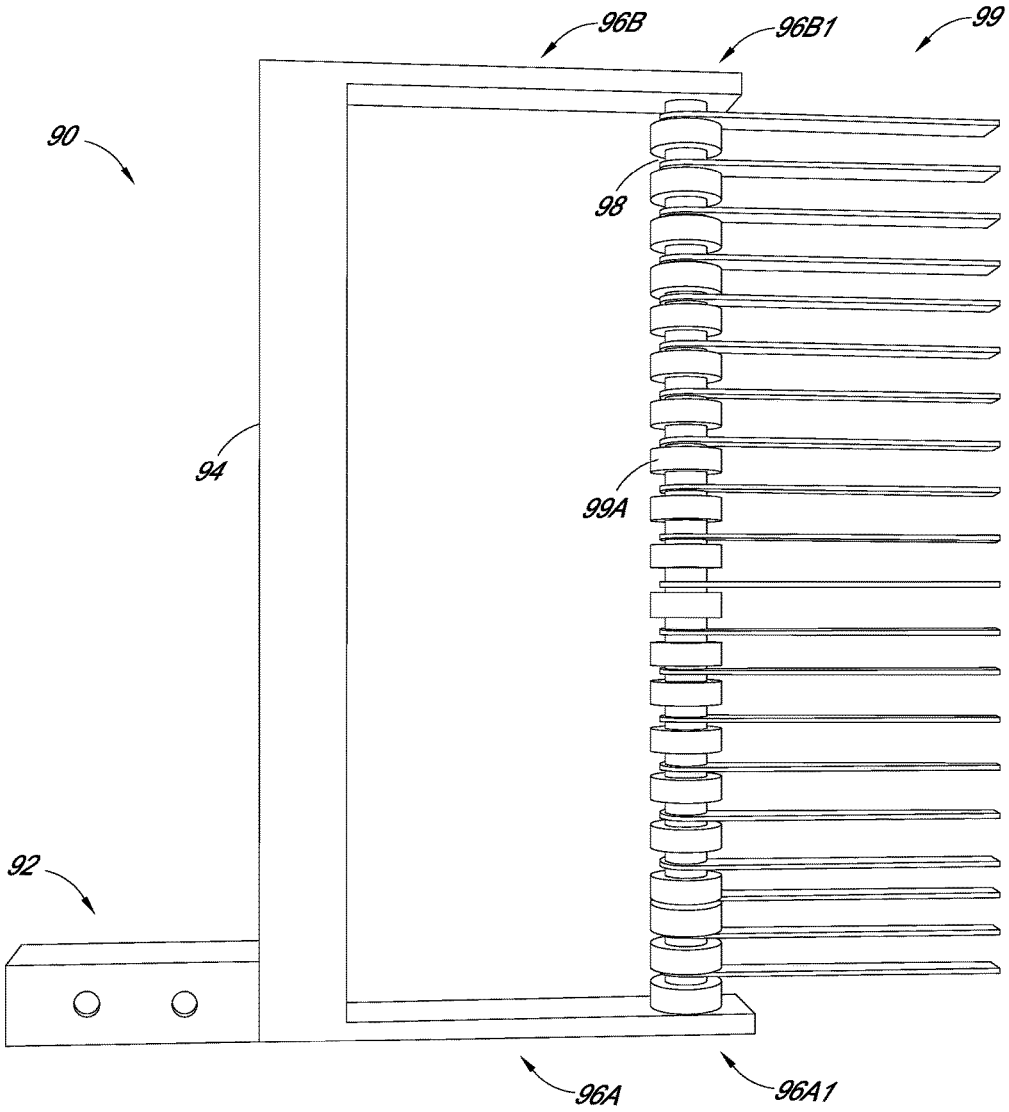
Figure 15A:
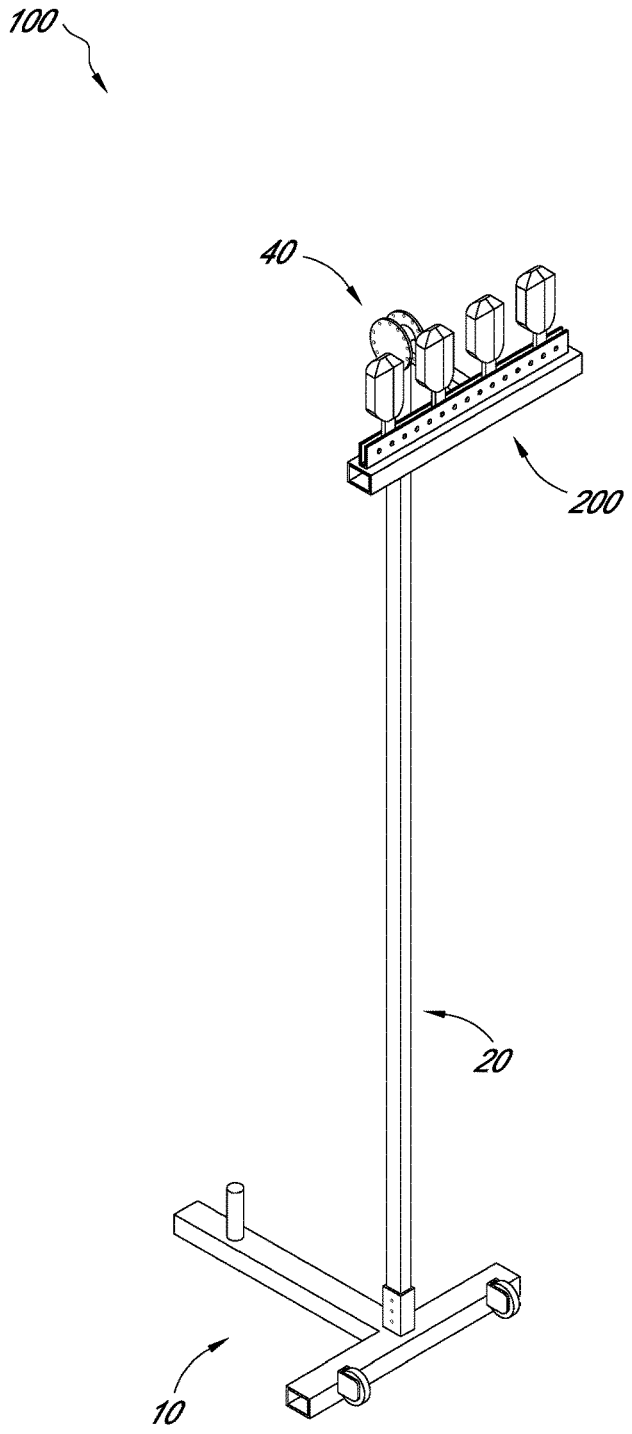
FIGS. 15A-15E shows another target member for use with the training apparatus.
Figure 15B:
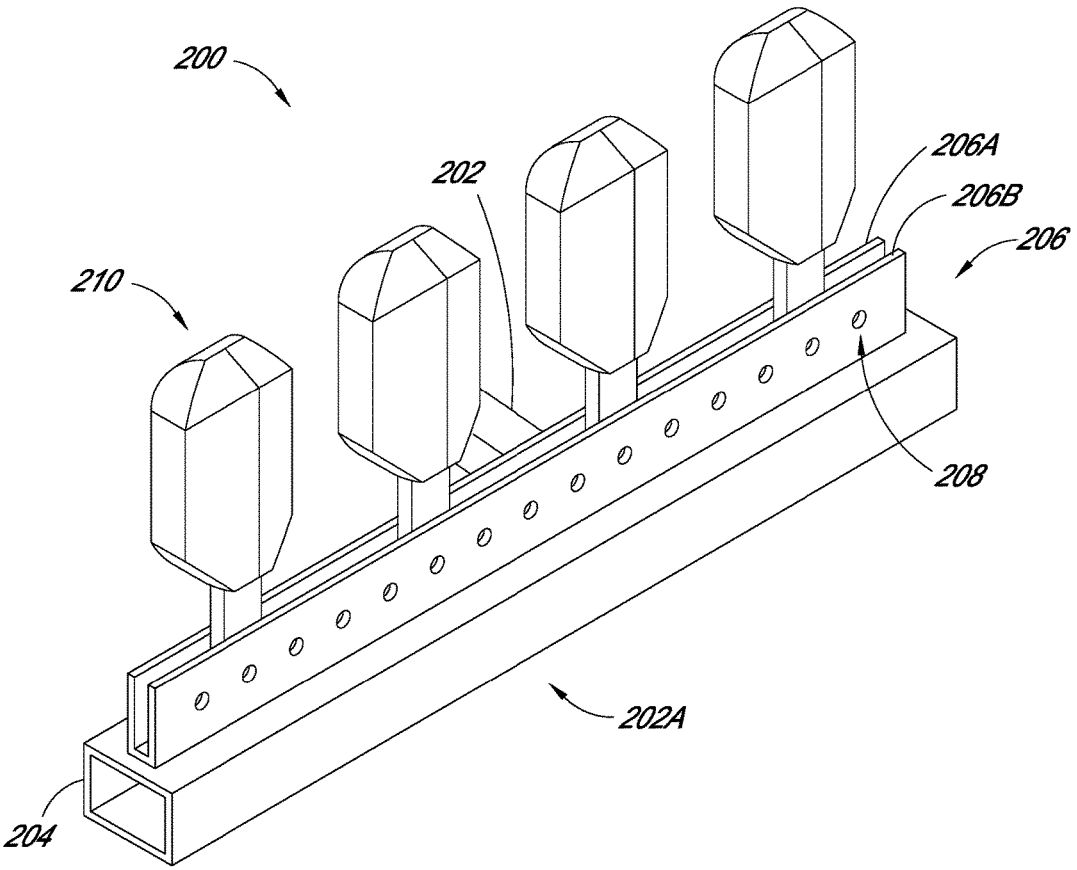
Figure 15C:
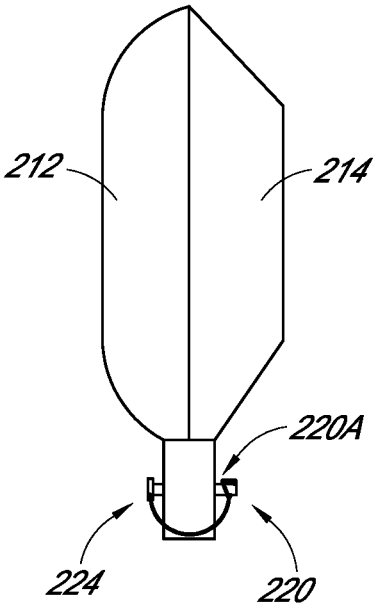
Figure 15D:
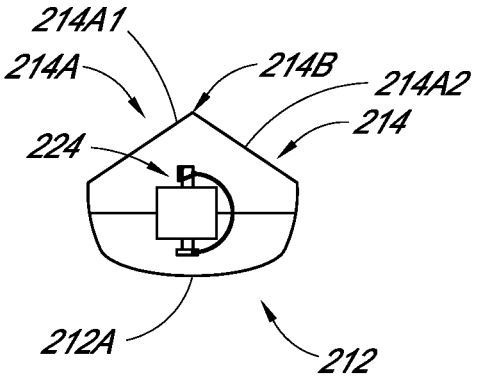
Figure 15E:
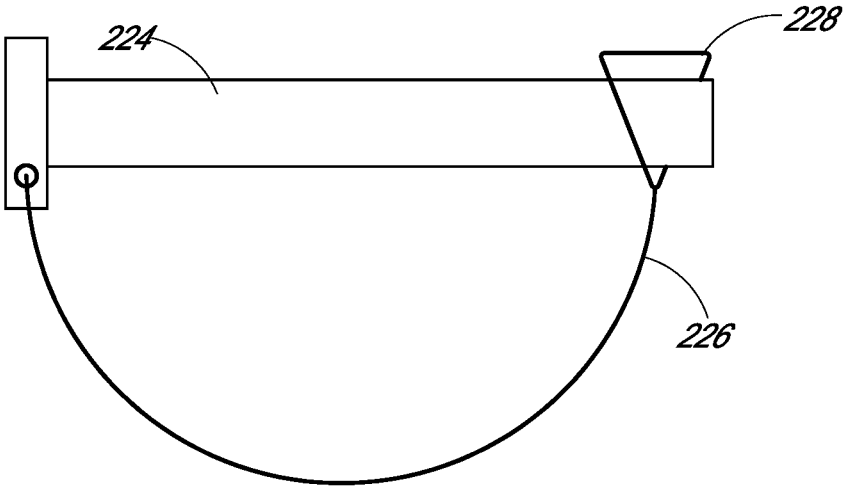

FIGS. 14-14C illustrate another embodiment of a target member 90 having a tube connector 92 via which it can couple to the bearing connector 48 of the bearing assembly 40 of the training apparatus 100. A distal portion of the tube connector 92 can be attached to a cross bar 94 (e.g. so that the tube connector 92 and cross-bar 94 extend substantially perpendicular to each other). A pair of bars 96A, 96B can extend from opposite ends of the cross-bar 94, so that the pair of bars 96A, 96B are orientated substantially perpendicular to the cross-bar 94 and disposed on an opposite side of the cross-bar 94 from the tube connector 92. A shaft or rod 98 can extend between and connect to distal portions 96A1, 96B1 of the pair of bars 96A, 96B. Optionally, the shaft or rod 98 extends generally parallel to the cross-bar 94.

The target member 90 can have a plurality of tabs or flaps 99 rotatably coupled to the shaft 98. The plurality of tabs 99 can optionally be spaced apart from each other by spacers 99A. Optionally, the tabs 99 can have a c-shaped proximal end 99B via which the tabs 99 removably couple to the shaft 98, where an inner diameter of the C-shaped proximal end 99B substantially corresponds to an outer diameter of the shaft 98. The tabs 99 can optionally releasably clip onto the shaft or rod 98, thereby allowing the tabs or flaps 99 to be readily removed or replaced, for example, if they break. The tabs 99 can optionally be made of plastic, or made of other suitable materials. Alternatively, the shaft or rod 98 can be removably coupled to the pair of bars 96A, 96B and the proximal end 99B of the tabs or flaps 99 can have a ring shape that can slide over the shaft or rod 98. Optionally, the rod 98 can be between about 1 foot and 2 feet in length, and the tabs or flaps 99 can be spaced approximately every ½ inch (e.g., 24 flaps 99 in a 1 foot long rod 98, or 48 flaps 99 in a 2 foot long rod 98), or spaced approximately every inch (e.g., 12 flaps 99 in a 1 foot long rod 98, or 24 flaps 99 in a 2 foot long rod 98), along the length of the rod 98. The spacers 99A can optionally be made of plastic.

Optionally, the shaft or rod 98 can be attached to the pair of bars 96A, 96B in a threaded manner. For example, the opposite ends of the rod 98 can be coupled to the pair of bard 96A, 96B by a pair of threaded fasteners (e.g., screws, bolts). Alternatively, a threaded nut can be attached to or incorporated into one of the bars 96A, 96B, a threaded fasteners (e.g., bolt) can extend through the other of the bars 96A, 96B, through a hollow bore in the shaft 98, and threadably couple to the nut.

In use, the target member 90 can be attached via its tube connector 92 to the training apparatus 100 (e.g., via the bearing connector 48 of the bearing assembly 40) and so that the rod 98 extends generally upright (e.g., vertically) and so that the plurality of flaps 99 extend generally laterally (e.g., horizontally). A user can jump and strike the flaps with their extended arm and hand to rotate the flaps 99 relatively to the rod 98. The number of flaps 99 the user is able to strike while jumping can provide a measurement of how high the user can jump. Accordingly, the user can perform jumping exercises to improve the height at which they can jump, and the target member 90 can provide an indication of how high the user can jump.

FIGS. 15A-15E illustrate another embodiment of a target member 200 having a tube connector 202 via which it can couple to the bearing connector 48 of the bearing assembly 40 of the training apparatus 100. A distal portion 202A of the tube connector 202 can be attached to a cross bar 204 (e.g. so that the tube connector 202 and cross-bar 204 extend substantially perpendicular to each other). The cross-bar 204 can include a rail member 206 with a plurality of holes or openings 208 along the length of the rail member 206. The rail member 206 can optionally be a channel defined by spaced apart parallel walls 206A, 206B. Optionally, the rail member 206 extends along a plane generally perpendicular to the tube connector 202.

The target member 200 can have one or more (e.g., a plurality of) pads 210 that can optionally be removably coupled to the cross-bar 204. For example, the one or more pads 210 can be coupled to the rail member 206 via a connector 220. Optionally, the connector 220 can extend into the channel of the rail member 206 between the pair of spaced apart parallel walls 206A, 206B. The connector 220 can optionally have an aperture 220A that can align with one of the openings 208 in the rail member 206, where the aligned aperture 220A and opening 208 can optionally receive a fastener therethrough to fixedly couple the one or more pads 210 with the rail member 206. Optionally, the fastener can be a pin 224 with a lock 228 that can couple to a distal end of the pin 224. A cable, chain or cord 226 can connect the lock 228 to a portion of the pin 224 to prevent the loss of the lock 228. Alternatively, the one or more pads 210 can be slidably coupled to the rail member 206, allowing the user to readily adjust a position of the pad 210 (e.g., reposition the pad) along the length of the rail member 206.

Each of the one or more pads 210 can optionally be made of a single material. Alternatively, the one or more pads 210 can be made of multiple materials. For example, the pad 210 can have a first portion 212 made of a soft (e.g., energy absorbing) material, such as foam, and have a second portion 214 made of a relatively harder material, such as plastic (e.g., hard plastic). The first and second portions 212, 214 can define opposite sides of the pad 210. The first portion 212 can optionally have a thickness of between about 1 inch and about 3 inches, such as about 2 inches. The first portion 212 can have a first surface 212A. Optionally, the first surface 212A can be generally planar (e.g., flat). The second portion 214 can have a second surface 214A. The second surface 214A can have a v-shape with a peak edge 214B generally at the middle of the second surface 214A that divides it into two sections 214A1, 214A2 that extend at an angle (e.g., angle less than 180 degrees) relative to each other. The one or more pads 210 can be coupled to the cross-bar 204 so that the first surface 212A or the second surface 214A faces the direction a user would hit the volleyball. Optionally, a plurality of pads 210 can be coupled to the cross-bar 204 so that the first surface 212A of all of the pads 210 face the direction a user would hit the volleyball. Alternatively, the plurality of pads 210 can be coupled to the cross-bar 204 so that the second surface 214A of all of the pads 210 face the direction a user would hit the volleyball. In still another option, the plurality of pads 210 can be coupled to the cross-bar 204 so that some have the first surface 212A and others have the second surface 214A facing in the direction a user would hit the volleyball. Optionally, the one or more pads 210 can be shaped like a hand.

In use, the target member 200 can be attached via its tube connector 202 to the training apparatus 100 (e.g., via the bearing connector 48 of the bearing assembly 40) and so that the cross-bar 204 extends generally laterally (e.g., horizontally) and so that the one or more pads 210 (e.g., a plurality of pads 210) extend generally upright (e.g., vertically). A user can hit a ball (e.g., volleyball) at the one or more pads 210, allowing the user to react to the blocking function of the pads 210 and the direction the pads 210 deflect the ball in, thereby exercising the user's skills in reacting to a blocked volleyball strike. Optionally, the target member can be disposed on an opposite side of a volleyball net from the user so that the one or more pads 210 extend above the volleyball net, simulating the extended hands of a blocking player. Alternatively, the volleyball net can be excluded and the user can hit the volleyball at the one or more pads 210. Advantageously, the one or more pads 210 provide different responses to a volleyball hit by the user, thereby allowing the user to exercise their reflexes. For example, when the first surface 212A faces the user and is struck by the volleyball, the relatively softer or energy absorbing material of the first portion 212 can deaden the hit and allow the ball to fall generally downward. In contrast, when the second surface 214A faces the user and is struck by the volleyball, the relatively harder (e.g., more stiff) second portion 214 can deflect the volleyball back. Moreover, the peak edge 214B and angled second surfaces 214A can deflect the volleyball back in different directions, causing the user to react to the different direction from the blocked ball.

In the illustrated embodiments, the base, support member and connectors can be made using square tubing. Advantageously, the square tubing allows for the connector 62, 72, 82, 92, 202 of the target member 60, 70, 80, 90, 200 to be coupled to the bearing connector 48 of the bearing assembly 40 in a manner that inhibits (e.g., prevents) rotation of the target member 60, 70, 80, 90, 202 left and right about an axis that intersects the vertical support member 20, such as when struck by a volleyball during use. However, in other embodiments round tubing can be used. The tubing is preferably strong (to inhibit bending of the device during use) and light (to facilitate moving the target device 100 during use from one location to another). In one embodiment, the target device 100 can be made of metal (e.g., stainless steel, aluminum, etc.). In one embodiment, the target device 100 can be painted so as to be easily visible (e.g., painted in a bright color) to allow users moving around the target device 100 to easily see where the target device 100 is located (e.g., to avoid running into it).

In one embodiment, the target device 100 can have a height H of between about 2 meters to about 4 meters, in some instances between about 2 meters and about 3 meters. The base can have a width W of between about 0.5 meters and about 1 meters, and a length L of between about 0.5 meters and about 1 meters. However, other suitable dimensions can be used. The target member 60 can have a ring with a diameter 60D of between about 500 mm and about 800 mm, in some instances about 750 mm. The target member 70 can have a diameter 70D of between about 500 mm and about 800 mm, in some instances about 750 mm, and a depth 70C of between about 150 mm and about 250 mm, in some instances about 200 mm. The target member 80 can have a ring with a diameter 80D of between about 300 mm and about 500 mm, in some instances about 400 mm.

In use, the user can attach a target member (e.g., target member 60, 70, 80, 90, 200) to the bearing assembly 40, in the manner discussed above. The user can also adjust the angular orientation of the target member by pivoting the hub 46 and bearing connector 48 to the desired orientation and inserting fasteners (e.g., pins) through openings in the plates 42 and the bearing connector 48 to fix the angular orientation of the target member 60, 70, 80, 90, 200 relative to the support member 20. The user can therefore advantageously change the angular orientation of the target member 60, 70, 80, 90, 200 (e.g., to 45 degrees, 90 degrees, etc. relative to the support member 20) to practice different volleyball skills, such as setting, passing or hitting, including hitting at an angle, and try to direct the volleyball through the target member 60, 70, 80, 90, 200. In one embodiment, one pin 50 locks the desired angle of the bearing connector 48 and another pin 50 locks the bearing connector 48 to the desired target member 60, 70, 80, 90, 200. Therefore, in one embodiment, only one pin 50 needs to be removed to adjust the angular orientation of the target member relative to the support member 20. Advantageously, the fasteners (e.g., pins 50) allow the angular orientation of the bearing assembly 40 and therefore the target member 60, 70, 80, 90, 200 connected thereto to be retained in a fixed manner relative to the support member 20, inhibiting (e.g., preventing) an inadvertent change in the angular orientation between the bearing assembly 40 and the support member 20 (e.g., due to wear and tear or a ball striking the target member 60, 70, 80, 90, 200).

While certain embodiments of the inventions have been described, these embodiments have been presented by way of example only, and are not intended to limit the scope of the disclosure. Indeed, the novel methods and systems described herein may be embodied in a variety of other forms. Furthermore, various omissions, substitutions and changes in the systems and methods described herein may be made without departing from the spirit of the disclosure. For example, one portion of one of the embodiments described herein can be substituted for another portion in another embodiment described herein. The accompanying claims and their equivalents are intended to cover such forms or modifications as would fall within the scope and spirit of the disclosure. Accordingly, the scope of the present inventions is defined only by reference to the appended claims.

Features, materials, characteristics, or groups described in conjunction with a particular aspect, embodiment, or example are to be understood to be applicable to any other aspect, embodiment or example described in this section or elsewhere in this specification unless incompatible therewith. All of the features disclosed in this specification (including any accompanying claims, abstract and drawings), and/or all of the steps of any method or process so disclosed, may be combined in any combination, except combinations where at least some of such features and/or steps are mutually exclusive. The protection is not restricted to the details of any foregoing embodiments. The protection extends to any novel one, or any novel combination, of the features disclosed in this specification (including any accompanying claims, abstract and drawings), or to any novel one, or any novel combination, of the steps of any method or process so disclosed.

Furthermore, certain features that are described in this disclosure in the context of separate implementations can also be implemented in combination in a single implementation. Conversely, various features that are described in the context of a single implementation can also be implemented in multiple implementations separately or in any suitable subcombination. Moreover, although features may be described above as acting in certain combinations, one or more features from a claimed combination can, in some cases, be excised from the combination, and the combination may be claimed as a subcombination or variation of a subcombination.

Moreover, while operations may be depicted in the drawings or described in the specification in a particular order, such operations need not be performed in the particular order shown or in sequential order, or that all operations be performed, to achieve desirable results. Other operations that are not depicted or described can be incorporated in the example methods and processes. For example, one or more additional operations can be performed before, after, simultaneously, or between any of the described operations. Further, the operations may be rearranged or reordered in other implementations. Those skilled in the art will appreciate that in some embodiments, the actual steps taken in the processes illustrated and/or disclosed may differ from those shown in the figures. Depending on the embodiment, certain of the steps described above may be removed, others may be added. Furthermore, the features and attributes of the specific embodiments disclosed above may be combined in different ways to form additional embodiments, all of which fall within the scope of the present disclosure. Also, the separation of various system components in the implementations described above should not be understood as requiring such separation in all implementations, and it should be understood that the described components and systems can generally be integrated together in a single product or packaged into multiple products.

For purposes of this disclosure, certain aspects, advantages, and novel features are described herein. Not necessarily all such advantages may be achieved in accordance with any particular embodiment. Thus, for example, those skilled in the art will recognize that the disclosure may be embodied or carried out in a manner that achieves one advantage or a group of advantages as taught herein without necessarily achieving other advantages as may be taught or suggested herein.

Conditional language, such as "can," "could," "might," or "may," unless specifically stated otherwise, or otherwise understood within the context as used, is generally intended to convey that certain embodiments include, while other embodiments do not include, certain features, elements, and/or steps. Thus, such conditional language is not generally intended to imply that features, elements, and/or steps are in any way required for one or more embodiments or that one or more embodiments necessarily include logic for deciding, with or without user input or prompting, whether these features, elements, and/or steps are included or are to be performed in any particular embodiment.

Conjunctive language such as the phrase "at least one of X, Y, and Z," unless specifically stated otherwise, is otherwise understood with the context as used in general to convey that an item, term, etc. may be either X, Y, or Z. Thus, such conjunctive language is not generally intended to imply that certain embodiments require the presence of at least one of X, at least one of Y, and at least one of Z.

Language of degree used herein, such as the terms "approximately," "about," "generally," and "substantially" as used herein represent a value, amount, or characteristic close to the stated value, amount, or characteristic that still performs a desired function or achieves a desired result. For example, the terms "approximately", "about", "generally," and "substantially" may refer to an amount that is within less than 10% of, within less than 5% of, within less than 1% of, within less than 0.1% of, and within less than 0.01% of the stated amount. As another example, in certain embodiments, the terms "generally parallel" and "substantially parallel" refer to a value, amount, or characteristic that departs from exactly parallel by less than or equal to 15 degrees, 10 degrees, 5 degrees, 3 degrees, 1 degree, or 0.1 degree.

The scope of the present disclosure is not intended to be limited by the specific disclosures of preferred embodiments in this section or elsewhere in this specification, and may be defined by claims as presented in this section or elsewhere in this specification or as presented in the future. The language of the claims is to be interpreted broadly based on the language employed in the claims and not limited to the examples described in the present specification or during the prosecution of the application, which examples are to be construed as non-exclusive.

What is claimed is:

1. A sport training apparatus, comprising:

a base;

a support member attached to the base at its distal end and extending generally perpendicular relative to the base;

a bearing assembly coupled to a proximal end of the support member, the bearing assembly having, a first and a second plate attached to opposing sides of the proximal end of the support member, each of the first and the second plates having a plurality of openings defined therein, the openings in the first plate being aligned with the openings in the second plate, a shaft connecting the first plate to the second plate, a hub portion disposed between the first and the second plates and angularly adjustable relative to the support member, the hub portion comprising a bearing ring rotatable around the shaft and a bearing connector extending from the bearing ring; and a target member removably coupleable to the hub portion of the bearing assembly by having a target member connector that is attached to the target member and is configured to engage the bearing connector by sliding the target member connector into the bearing connector, wherein an angular orientation of the target member relative to the support member is selectively adjustable to a plurality of discrete angular orientations, and wherein the target member connector and the bearing connector each have a plurality of apertures, at least one of the apertures in the target member connector and one of the apertures in the bearing connector becoming aligned after the telescopic coupling.

2. The training apparatus of claim 1, wherein a height of the support member is adjustable.

3. The training apparatus of claim 1, wherein the base is T-shaped.

4. The training apparatus of claim 1, wherein the base includes a pin configured to receive a weight thereon to act as a counterweight to maintain the training apparatus in a generally fixed location.

5. The training apparatus of claim 1, wherein the target member includes a hoop with a circular opening configured to receive a volleyball therethrough.

6. The training apparatus of claim 1, wherein the target member comprises a semicircular arc that defines an opening configured to receive a volleyball therethrough.

7. The training apparatus of claim 1, wherein the target member comprises one or more pads oriented generally perpendicular to a cross-bar, the cross-bar oriented generally perpendicular to the support member, the one or more pads configured to deflect a ball that strikes the one or more pads.

8. The training apparatus of claim 7, wherein the one or more pads configured to deflect a ball further include a first portion made of an energy absorbent material and a second portion opposite the first portion, the second portion made of a hard plastic material than the first portion.

9. The training apparatus of claim 7, wherein the one or more pads have a first face that is outwardly convex and a second, opposite face that comprises a plurality of planar surfaces.

10. The training apparatus of claim 9, wherein the plurality of planar surfaces comprises two surfaces disposed to form a V-shape having an outwardly projecting peak edge between the two surfaces.

11. The training apparatus of claim 1, wherein the target member comprises a plurality of flaps rotatably coupled to a rod, the rod extending generally vertically and the plurality of flaps extending generally horizontally, the plurality of flaps configured to indicate a jumping height of a user when struck and rotated relative to the rod.

12. The training apparatus of claim 1, further comprising a first pin which engages one of the openings in the first plate with one of the openings in the second plate that are mutually aligned, and to further engage a first one of the apertures in the target member connector and a first one of the apertures in the bearing connector that are also mutually aligned, thereby fixing the target member connector in one of the plurality of discrete angular orientations.

13. The training apparatus of claim 1, further comprising a second which engages a second one of the apertures in the target member connector and a second one of the apertures in the bearing connector, thereby fixing the bearing assembly to the target member.

14. The training apparatus of claim 1, wherein the target member connector engages the bearing connector by sliding the target member connector into the bearing connector, and further wherein said target member connector includes a longitudinal portion and said bearing connector includes a longitudinal portion, whereby said target member longitudinal portion receives a longitudinal portion of the bearing connector.

15. The training apparatus of claim 1, wherein the target member connector engages the bearing connector longitudinal portion by receiving said longitudinal portion of the bearing connector.

* * * * *